United States Patent [19]

Shoofler

[11] 4,103,887

[45] Aug. 1, 1978

[54] BARBELL WITH COLLAPSIBLE LOAD CARRYING CHAMBERS

[76] Inventor: Renald Shoofler, 777 Greene Ave., Montreal, Quebec, Canada, H4C 2J8

[21] Appl. No.: 772,350

[22] Filed: Feb. 28, 1977

[51] Int. Cl.[2] ..... A63B 13/00

[52] U.S. Cl. ..... 272/123; 222/528; 128/272; 273/DIG. 5

[58] Field of Search ..... 272/122, 123, 117, 116, 272/DIG. 5, DIG. 4, 96, 94; 215/1 C, DIG. 3; 128/272; 99/323; 222/528

[56] References Cited

U.S. PATENT DOCUMENTS

| | | | |
|---|---|---|---|
| 3,226,117 | 12/1965 | Walklet | 272/123 |
| 3,231,270 | 1/1966 | Winer | 272/123 |
| 3,756,597 | 9/1973 | Monti | 272/123 |
| 3,781,007 | 12/1973 | Baker et al. | 272/123 |

*Primary Examiner*—William R. Browne

[57] ABSTRACT

Portable barbell apparatus is disclosed comprising a collapsible enclosure made of a synthetic polymeric material. The enclosure has a base and an aperture for filling the enclosure. The center of gravity of the enclosure is between the aperture and the base, an opening being provided in the enclosure for receiving the end of a weight supporting bar, the opening being positioned in between the center of gravity and the aperture. This arrangement allows for the positioning of a pair of the enclosures on either end of a weight supporting bar after which the enclosures may be filled with water, sand or other particulate material so that the assembly may be employed as a barbell. When not in use, the enclosures may be removed from the weight supporting bar, emptied and conveniently transported and/or stored. The aperture comprises a slit and has a resilient member extending around the periphery thereof to resiliently bias the slit to a closed position.

7 Claims, 4 Drawing Figures

BARBELL WITH COLLAPSIBLE LOAD CARRYING CHAMBERS

SUMMARY OF THE INVENTION

The present invention relates to exercising apparatus comprising a collapsible enclosure having side wall members and an end wall base, a walled opening being provided in the enclosure for receiving the ends of a weight supporting bar. The center of gravity of the enclosure is positioned between the base and the walled opening. An openable and closeable aperture is provided in the enclosure, the walled opening and the center of gravity of the enclosure being in between the aperture and the base. The side wall members are flexible and comprise a flexible polymeric material. The side wall members extend to the aperture, the aperture comprising a slit in a wall of the enclosure, a resilient member extending around the periphery of the slit to resiliently bias the slit in a closed position.

The resilient member may comprise a spring metal pin extending around the aperture, the side walls projecting around the pin to substantially enclose the pin.

The walled opening may extend through the enclosure so that a weight supporting bar may be extended through the enclosure.

The walled enclosure may comprise a rounded opening to rotatably receive the rounded end of a weight supporting bar.

All of the walls of the enclosure are flexible and comprise a flexible polymeric material. The aperture when in a closed position is substantially watertight whereby a pair of the enclosures may be collapsed and stored prior to use and in use positioned on the ends of a weight supporting bar and filled with water, sand, shot or other flowable particulate matter through the aperture for converting the enclosure into a barbell weight.

DETAILED DESCRIPTION

Figure 1:
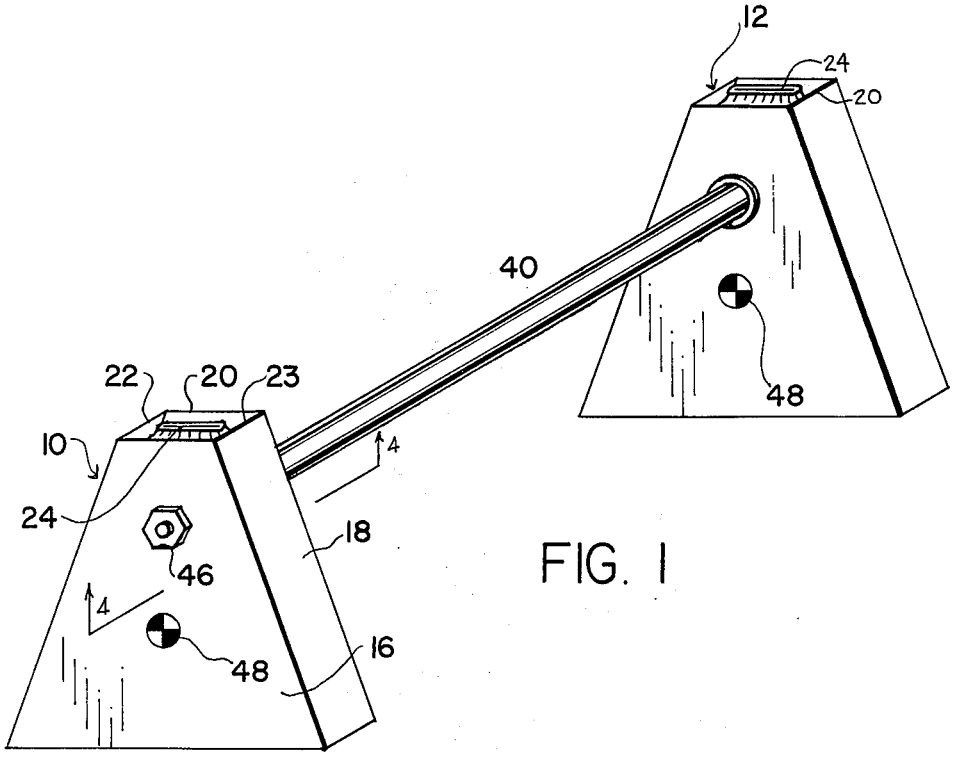
FIG. 1 comprises a perspective view of a pair of collapsible enclosures positioned on the end of a weight supporting bar according to one embodiment of the present invention.

Exercising devices having containers thereon which may be filled with a material for adding weight to the devices are disclosed in U.S. Pat. Nos. to Monti 3,756,597; Boxko, et al. 3,334,889; Wittenberg et al. 990,791 and Johnson 983,372.

The Monti patent noted above comprises a pair of plastic jars attached to a weight supporting bar through tubes that pivot at the end of the weight supporting bar. The plastic containers, however, are not disclosed as being flexible but are transparent and have indicia thereon for indicating the amount of water that may be added to the container. The Monti device as a result is not easily transported or stored for the reason that the weight supporting bar has a pair of tubes extending from the ends thereof and that the containers are not collapsible.

A prior art patent discloses an unnecessarily complicated container constructions in which an opening is provided in the container, the opening having watertight seals extending around the periphery for sealing the container to a weight supporting bar. The container consists of a rigid section connected to a collapsible section which is moved along the length of the weight supporting bar on which it is suspended so that the volume of the container may be varied and the amount of water or other filling material may also be varied. The prior art device is not readily stored because of the construction of the container in which a rigid and a collapsible section are employed and further the arrangement of seals on the prior art device are expensive to manufacture and are also the source of leakage of aater from the container. Because the containers of prior art are provided on opposite ends of a weight supporting bar, uneven leakage from one container as compared to the other would cause the bar to be disproportionately heavier at one end that tne other and tend to cause a person using the device to be thrown off balance while exercising which would result in injury.

It is therefore, an object of the present invention to avoid these and other difficulties encountered in the prior art.

It is a further object of the present invention to provide a novel exercising apparatus.

It is a further object of the present invention to provide an enclosure for a barbell which uses water or a particulate material whereupon after exercising a person may discard the water or filling material thereby leaving a lightweight barbell which may be easily handled and stored.

It is also an object of the present invention to provide an enclosure which may be used as a barbell weight wherein the center of gravity of the enclosure is positioned in between the base of the enclosure and an opening for receiving a weight supporting bar.

It is also an object of the present invention to provide an enclosure which may be used as a barbell weight which is completely collapsible.

It is also an object of the present invention to provide an enclosure which may be used as a barbell weight in which the opening of the enclosure is self sealing and positioned opposite the base of the enclosure so that the center of gravity and the opening for receiving a weight supporting bar are between the aperture and the base of the enclosure.

It is a further object of the present invention to provide an enclosure which may be employed as a barbell weight that is easily manufactured at relatively low cost and may be transported and stored readily.

These and other objects have been achieved according to the present invention and will become apparent by reference to the disclosure and claims that follow as well as the appended drawing.

Referring to the drawing and FIGS. 1–4, exercising apparatus comprising enclosures 10 and 12 are illustrated, enclosure 12 being identical in structure to enclosure 10. With respect to enclosure 10, a base 14 is provided from which side walls 16, 18, 20 and 22 extend towards a top wall 23 in pyramid fashion. An aperture 24 is provided in the top wall 23, a resilient pin 26 extending around the aperture for resiliently biasing the aperture 24 in a closed position. The side walls 16 and 20 project around the pin 26 to form an enclosure 28 to protect the pin from rusting where a spring metal pin 26 is employed and also to provide a surface which may be pressed together at the aperture 24 for sealing the aperture. The enclosure 10 and 12 are made of a collapsible polymeric material such as polyvinylchloride which is plasticized with compounds known in the art such as dioctylphthlate and the art known equivalents thereof. Additionally, the enclosures 10 and 12 may be fabricated from natural or synthetic rubbers and may also have fiber or fabric reinforcing embedded in the walls of the enclosures or surrounding walls of the enclosures. The enclosure 10 defines an open space 32 within the walls thereof, the space 32 being filled by materials to weight the enclosure such as water 34 or particulate material such as sand, lead or steel or iron shot and the art known equivalents thereof. An opening 36 is positioned in the enclosure 10, the opening 36 being surrounded by an internal wall 38. Opening 36 is of a sufficient diameter and preferably is a round opening so that the round end of a weight supporting bar 40 may be journaled in the opening 38. A washer 42 is positioned in between the weight supporting bar 40 and the enclosure 10, threads 44 being provided on the end of weight supporting bar 40 to threadably receive a nut 46.

The center of gravity 48 of the enclosure 10 is positioned in between the opening 36 and the base 14. The opening 30 in the enclosure 10 is also positioned in between the center of gravity 48 and the aperture 24. In one embodiment, the opening 36 is of a sufficient diameter so that the end of weight supporting bar 40 may be rotatably mounted in the opening 36 so that as the barbell illustrated in FIG. 1 is lifted, the weighted enclosure 10 will not apply a torque to the bar 40 as it is being moved upwardly through an arc as is the case in some weight lifting exercises.

Figure 2:
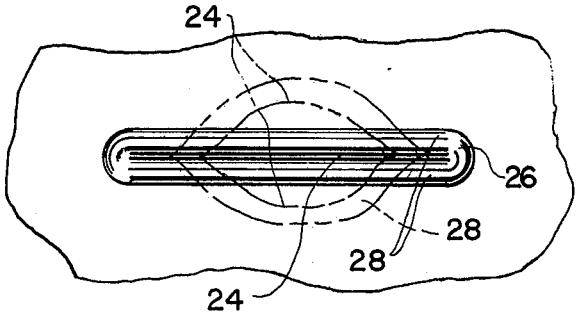
FIG. 2 comprises a plan view of an aperture positioned opposite the base of the enclosure illustrated in FIG. 1 which is resiliently biased in a closed position, FIG. 2 also showing in phantom configuration the aperture in an opened position.
Figure 3:
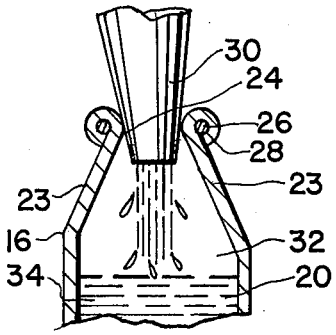
FIG. 3 comprises a partial side elevation in section of an enclosure as illustrated in FIG. 1 in which the aperture is separated so that a hose nozzle may be inserted therein for delivering water to the collapsible enclosure so that it may be converted into a barbell weight according to another embodiment of the present invention.
Figure 4:
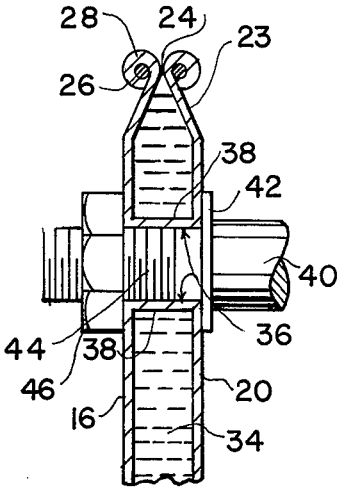
FIG. 4 comprises a side elevation in section taken along the line 4—4 from FIG. 1.

In use, the opening 24 is separated as is illustrated in the phantom configuration of opening 24 in FIG. 2 and a hose nozzle 30 is inserted therein for filling the enclosure 10 with water. The hose nozzle 30 is then removed and the resiliency of the pin 26 is sufficient so as to force the opening 24 into a closed position as is illustrated in FIG. 2. With both weights 10 and 12 attached to the weight supporting bar 40 in the manner illustrated by FIG. 4, a barbell is provided which may be readily transported and stored by collapsing the enclosure 10 and 12 after they are emptied of water or other weight materials. Prior to use, the enclosures 10 and 12 may be filled as previously described. This arrangement allows for the enclosures 10 and 12 to be taken along with a weight supporting bar 40 to resort areas such as beaches, lakes and the like, filled with water and used after which the enclosures are emptied and flattened which allows them to be readily stored and transported.

Although the invention has been described by reference to some embodiments, it is not intended that the novel exercising apparatus be limited thereby but that modifications thereof are intended to be included as falling within the broad spirit and scope of the foregoing disclosure, the following claims and the appended drawing.

What is claimed is:

1. Exercising apparatus comprising two collapsible enclosures, each said enclosure having side walls and an end wall base, a walled opening in each of said enclosure side walls for receiving the end of a weight supporting bar, a support bar connecting said enclosures, the center of gravity of each of said enclosure being positioned between each said base and each said walled opening, an openable and closable aperture in each of said enclosures opposite the end wall base, each said wall opening and the center of gravity of each said enclosure being positioned in between each said aperture and each said base, each said side wall being flexible and composed of flexible polymeric material, each said side wall extending from the base to said aperture, each said openable and closable aperture comprising a slit in a wall of said enclosure, resilient means extending around the periphery of each of said apertures to resiliently bias said slit to a closed position to retain a weighted substance in each said enclosure.

2. The apparatus of claim 1 where said resilient means comprises a spring metal pin extending around said aperture, said side walls projecting around said pin to substantially enclose said pin.

3. The apparatus of claim 2, wherein said walled opening extends through said walled enclosure so that a weight supporting bar may be extended through said enclosure.

4. The apparatus of claim 3, where said walled enclosure comprises a rounded opening to rotatably receive the rounded end of a weight supporting bar.

5. The apparauts of claim 4, where all of the walls of said enclosure are flexible and comprise a flexible polymeric material, said aperture when in a closed position being substantially water tight whereby a pair of said enclosures may be collapsed and stored prior to use and in use positioned on the end of a weight supporting bar and filled with water, sand, shot or another flowable material through said aperture for converting said enclosures into a barbell weight.

6. The apparatus of claim 5, where said side wall means taper from said base towards said aperture.

7. A collapsible enclosure having side wall means and an end wall base, a walled opening in said enclosure for receiving an end of a weight supporting bar, the center of gravity of said enclosure being positioned between the base and the walled opening, an openable and closable operture in said enclosure, said wall opening and the center of gravity of said enclosure being in between said aperture and said based, said side wall means being flexible and is composed of flexible polymeric material, each said side wall entending to said aperture, resilient means extending around the periphery of said aperture to resiliently bias said slit of a closed position to retain a weighted substance in said enclosure.

* * * * *